United States Patent [19]

Veyrat

[11] Patent Number: 4,797,071

[45] Date of Patent: Jan. 10, 1989

[54] MOTOR AND VANE-PUMP ASSEMBLY FREE FROM EXTERNAL OIL LEAKS

[75] Inventor: Gilles Veyrat, Minzier, France

[73] Assignee: Alcatel, Paris, France

[21] Appl. No.: 166,781

[22] Filed: Mar. 1, 1988

Related U.S. Application Data

[63] Continuation of Ser. No. 900,434, Aug. 26, 1986, abandoned.

[30] Foreign Application Priority Data

Aug. 27, 1985 [FR] France ..... 85 12774

[51] Int. Cl.[4] ..... F04B 17/00

[52] U.S. Cl. ..... 417/410

[58] Field of Search ..... 417/366, 357, 373, 410, 417/423 M, 423 T

[56] References Cited

U.S. PATENT DOCUMENTS

| | | | |
|---|---|---|---|
| 2,762,311 | 9/1956 | Litzenberg | 417/357 |
| 2,763,214 | 9/1956 | White | 417/357 |
| 2,825,286 | 3/1958 | White . | |
| 2,958,292 | 11/1960 | Lipe et al. | 417/357 |
| 3,192,861 | 7/1965 | Haegh | 417/357 |
| 3,309,009 | 3/1967 | Culk | 417/357 |
| 3,515,167 | 6/1970 | Svenson . | |
| 4,123,201 | 10/1978 | Andriolis | 417/204 |
| 4,362,480 | 12/1982 | Suzuki et al. . | |

FOREIGN PATENT DOCUMENTS 3245973 6/1984 Fed. Rep. of Germany .

*Primary Examiner*—Carlton R. Croyle
*Assistant Examiner*—Timothy S. Thorpe
*Attorney, Agent, or Firm*—Sughrue, Mion, Zinn, Macpeak & Seas

[57] ABSTRACT

The invention provides a motor and vane-pump set comprising a vane-pump comprising a stator (53) and a rotor (50) fitted with vanes (52) and extended by a shaft (51), with the rotor and stator assembly being disposed in a tank (71) which is partially filled with oil, with the shaft rotating in bearings lubricated by said oil and fitted with sealing rings (61,62), said pump being rotated by an electric motor comprising a stator (44) and a rotor (48) fitted with a shaft (48), the motor and vane-pump set being characterized in that the rotor shafts (48, 51) of the motor and the pump are joined together and in that an envelope (75) of non-magnetic material is disposed between the stator (44) and the rotor (47) of the motor, said envelope being closed at its far end from the pump by a cover (77), and bearing in sealed manner at its opposite end on a motor end plate (76) which is fixed to the pump.

7 Claims, 3 Drawing Sheets

MOTOR AND VANE-PUMP ASSEMBLY FREE FROM EXTERNAL OIL LEAKS

This is a continuation of application Ser. No. 900,434 filed Aug. 2, 1986 now abandoned.

The present invention relates to a motor and vane-pump set free from external oil leaks.

In the state of the art, a vacuum vane-pump as associated with a tank of oil is driven by an electric motor.

Figure 1:
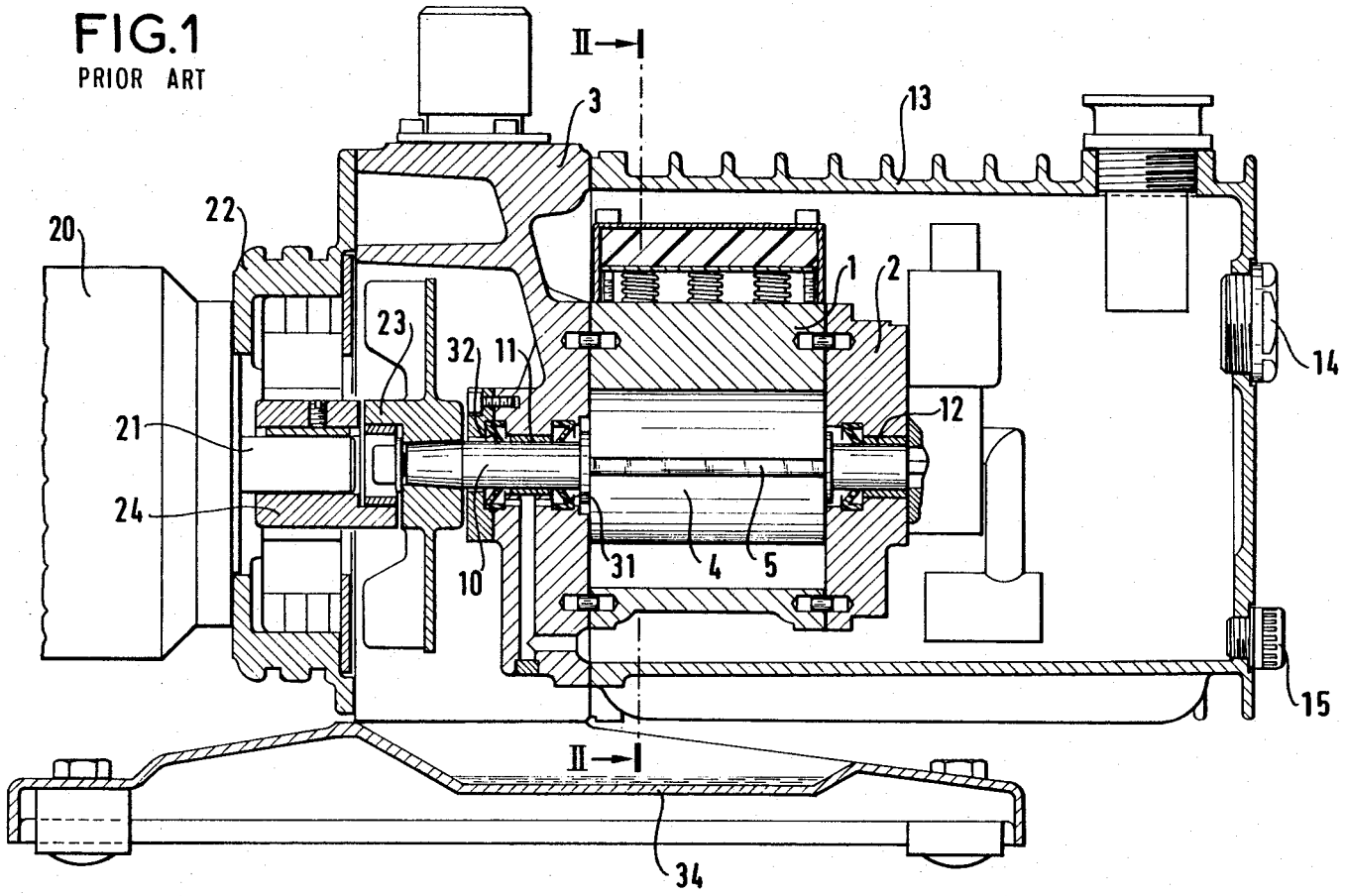
FIG.1 PRIOR ART
FIG. 1 is an axial section through a prior art vane-pump and its drive motor.
Figure 2:
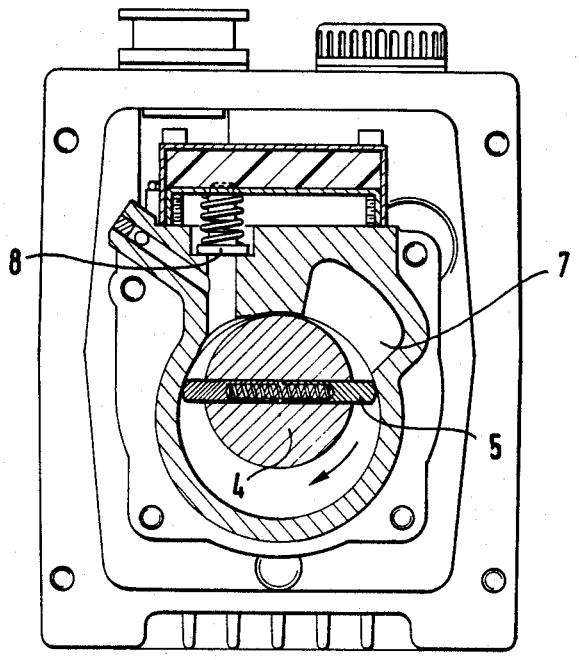
FIG. 2 PRIOR ART
FIG. 2 is a cross-section on line II—II of FIG. 1.

FIGS. 1 and 2 show the pump stator referenced 1 enclosed between end plates 2 and 3.

The rotor 4 of the pump carries vanes such as 5. The gas to be pumped arrives via a suction orifice 7 and leaves via valves such as 8.

The rotor 8 is fitted with a shaft rotating in bearings in the end plates. The bearings 11 and 12 are smooth and they are lubricated by oil in which the pump is immersed. The oil is contained in a case 13 fitted with a level indicator 14 and an emptying orifice 15. For the puroses of clarifying the description, the oil pump and the oil filter which are generally fitted to the pump have not been shown.

The pump is rotated by a motor 20 having a shaft 21 and an end plate 22 for fixing to the end plate 3 of the pump. The motor shaft 21 and the pump rotor shaft 10 are interconnected by a resilient coupling sleeve 23, 24 which may also serve as a fan for cooling the pump.

A pump side lip seal 31 prevents air leakage between the atmosphere and the suction inlet to the pump.

A coupling sleeve side lip seal 32 is intended to prevent major leakage of oil and grease from the smooth bearing.

However, its dynamic sealing is not perfect and the lip seal 32 cannot prevent oil seepage between the shaft and the lip.

Oil then runs over the outside of the pump and is collected in the base 34 of the pump.

Oil leaks are undesirable for two reasons:

in many applications, the pump is used to pump toxic products (for example fluorine or chlorine compounds). These products become mixed with or dissolved in the oil and thus any leak, however small, of oil containing a toxic product must be prevented. The slightest leak in a clean room immediately causes it lose its "clean" status.

also, in some applications, the synthetic oil used in the pump is a very expensive product and it is essential to avoid losing any.

An aim of the present invention is to provide a motor and vane-pump set having no external oil leak.

The invention provides a motor and vane-pump set comprising a vane-pump comprising a stator and a rotor fitted with vanes and extended by a shaft, with the rotor and stator assembly being disposed in a tank which is partially filled with oil, with the shaft rotating in bearings lubricated by said oil and fitted with sealing rings, said pump being rotated by an electric motor comprising a stator and a rotor fitted with a shaft, the motor and vane-pump set being characterized in that the rotor shafts of the motor and the pump are joined together and in that an envelope of non-magnetic material is disposed between the stator and the rotor of the motor, said envelope being closed at its far end from the pump by a cover, and bearing in sealed manner at its opposite end on a motor end plate which is fixed to the pump.

The invention is explained by the description given below of a preferred embodiment of the invention and with reference to the accompanying drawings, in which:

FIG. 1 is an axial section view through a prior art pump;

FIG. 2 is a cross-section on line II—II of FIG. 1; and

Figure 3:
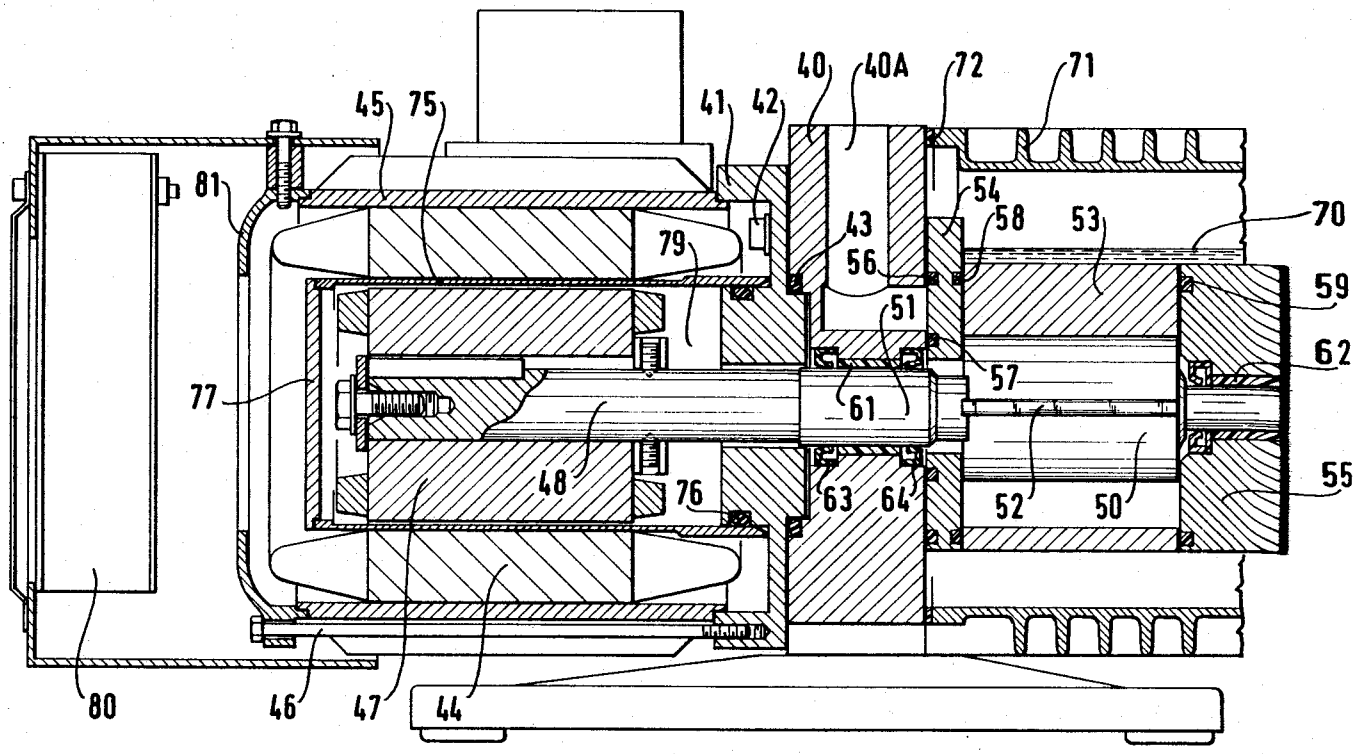

FIG. 3 is an axial section through a motor and pump set in accordance with the invention.

The motor and pump set in accordance with the invention (see FIG. 3) comprises a support 40 which is common to the pump and the drive motor. A bore 40A constitutes the pump suction duct.

The motor includes an end plate 41 fixed to the support by bolts 42. Sealing is provided between the end plate 41 and the support by an O-ring 43.

The motor includes a stator constituted by windings such as 44 disposed in a body 45 which is fixed to the end plate by draw rods such as 46.

The motor also includes a squirrel-cage rotor 47 which is keyed and bolted to a shaft 48.

The pump includes a stator 53 and a rotor 50 having a shaft 51 and vanes 52. The pump rotor shaft 51 and the motor rotor shaft 58 are made as a single part.

The pump stator is disposed between two end plates 54 and 55. O-rings 56 and 57 provide sealing between the support 40 and the end plate 54.

Similarly, O-rings 58 and 59 provide sealing between the stator and the end plates 54 and 55 respectively.

The shaft 51 rotates in bearings 61 and 62 in the frame 40 and in the end plate 55 respectively. These bearings are lubricated by the pump's oil.

Lip seals 63 and 64 are disposed on either side of the bearing 61.

Oil is contained in a finned tank 71 which is connected to the support 40 by means of a flat gasket 72.

The oil reaches a level 70 which is higher than the top of the stator 53.

In accordance with a characteristic of the invention, the motor and pump rotor shafts 48 and 51 are joined together and are preferably welded so as to constitute a single shaft.

In accordance with another characteristic of the invention, a sleeve 75 of non-magnetic material is disposed in the gap between the stator 44 and the rotor 47 of the electric motor. This sleeve has one end bearing against a step in the end plate 41 via an O-ring 76.

The other end of the sleeve is closed by a flat cover 77.

By virtue of this disposition, the rotary assembly of the motor and pump set no longer has any contact with the atmosphere. Since all the seals are static, good sealing is provided.

Any oil which may leak through the lip seal 63 remains inside the sleeve 75 and cannot escape to the outside.

It progressively fills the volume 70 between the rotor 47 and the end plate 41, but oil accumulation here does not disturb operation of the motor. This oil may be periodically removed, for example when the equipment is disassembled for maintenance or when the oil is replaced (changed).

The set may additionally be fitted with an independent fan 80 fixed to an end plate 81 which is in turn fixed to the motor by the draw rods 46.

Prior art primary (or backing) pumps may readily be converted into motor and pump sets in accordance with the invention since the entire vane-pump and oil tank portion remains unchanged.

I claim:

1. A motor and vane-pump set comprising a vane-pump for pumping a gas and comprising a stator (53) and a rotor (50) fitted with vanes (52) and extended by a shaft (51), a gas suction duct (40A) leading to the interior of the stator (53), said rotor and stator assembly being immersed in a tank (71) partially filled with oil, said shaft rotating in bearings (61, 62) lubricated by said oil immersing said rotor and stator assembly and fitted with lip seals (63, 64) said pump shaft being rotated by an electric motor open to the atmosphere comprising a stator (44) and a rotor (47) fitted with a shaft (48), the motor and vane-pump set being characterized in that the rotor shafts (48, 51) of the motor and the pump are joined together and in that a sleeve (75) of non-magnetic material is coaxially disposed between the stator (44) and the rotor (47) of the motor, said sleeve being closed at its far end from the pump by a cover (77), and fixedly mounted in a sealed manner at its opposite end on a motor end plate (41) which is fixed to the pump, whereby said sleeve (75), said cover (77) and said motor end plate (41) form a sealed volume (79) which collects oil leaking through the lip seal (63) to prevent it from contaminating the exterior of the motor and vane-pump set without disturbing the motor operation.

2. A motor and pump set according to claim 1, characterized in that the shafts (51, 48) of the pump rotor and of the electric motor rotor are made as a single part.

3. A motor and pump set according to claim 1 or 2, characterized in that it includes a metal support (40) to which a motor end plate (41), a pump end plate (54), and a pump oil tank (71) are all fixed.

4. A motor and pump set according to claim 3, characterized in that a flat O-gasket (72) is disposed between the tank (71) and the support (40).

5. A motor and pump set according to claim 3, characterized in that at least one O-ring (56) is disposed between the support (40) and said pump end plate (54).

6. A motor and pump set according to claim 3, characterized in that at least one O-ring (76) is disposed between the support (40) and the motor end plate (41).

7. A motor and pump set according to claim 1, wherein said stator includes a fixed stator winding surrounding said envelope, and said motor and pump set further comprises a fan (80) fixed to said motor stator (44) facing said stator windings for directing cooling air over said stator winding.

* * * * *